US011243486B2

(12) United States Patent
Wilde et al.

(10) Patent No.: US 11,243,486 B2
(45) Date of Patent: Feb. 8, 2022

(54) HEAT SOURCE SEGMENTS ALIGNED WITH DIFFERENT SIZES

(71) Applicant: HP Indigo B.V., Amstelveen (NL)

(72) Inventors: Oren Wilde, Nes Ziona (IL); Yury Levchakov, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/632,591

(22) PCT Filed: Oct. 25, 2017

(86) PCT No.: PCT/EP2017/077369
§ 371 (c)(1),
(2) Date: Jan. 21, 2020

(87) PCT Pub. No.: WO2019/081017
PCT Pub. Date: May 2, 2019

(65) Prior Publication Data

US 2020/0247168 A1 Aug. 6, 2020

(51) Int. Cl.
*G03G 15/20* (2006.01)
*G03G 15/16* (2006.01)

(52) U.S. Cl.
CPC ..... *G03G 15/169* (2013.01)

(58) Field of Classification Search
CPC ..... G03G 15/2003; G03G 15/2007; G03G 15/2042; G03G 15/2046; G03G 15/2053
(Continued)

(56) References Cited

U.S. PATENT DOCUMENTS 5,355,203 A * 10/1994 Nishikawa et al. ..... G03G 15/2053 399/334
5,500,667 A 3/1996 Schwiebert et al.
(Continued)

FOREIGN PATENT DOCUMENTS

CN 1206858 A 2/1999
CN 102667638 A 9/2012
(Continued)

OTHER PUBLICATIONS

MUTOH's Infra Red Dryers Optional Infra Red Dryer for Mutoh Solvent & Direct Textile Printers, Jul. 6, 2011, http://www.mutoh.eu/Portals/0/MutohData/DocumentLibrary/Public%20Zone/Downloads/Brochures/Brochure%20IRDryer.pdf.

*Primary Examiner* — William J Royer
(74) *Attorney, Agent, or Firm* — Brooks Cameron & Huebsch PLLC

(57) ABSTRACT

Disclosed is a heat source for radiating heat onto an intermediate printing material transfer element of a printing apparatus. The heat source can include a plurality of heat generating segments disposed along an axis, the plurality of heat generating segments including a first heat generating segment, a second heat generating segment and a third heat generating segment. The second heat generating segment is disposed between the first heat generating segment and the third heat generating segment. The second heat generating segment has a length shorter than a length of the first heat generating segment and shorter than a length of the third heat generating segment. Also disclosed is a printing system that includes the disclosed heat source. Also disclosed is a method of selecting a heat radiating pattern of a heat source.

14 Claims, 7 Drawing Sheets

(58) Field of Classification Search
USPC ..... 399/330, 334
See application file for complete search history.

(56) References Cited

U.S. PATENT DOCUMENTS

| | | | | |
|---|---|---|---|---|
| 6,490,423 | B2 | 12/2002 | Horobin et al. | |
| 6,882,804 | B2 | 4/2005 | Eskey | |
| 7,457,557 | B2 | 11/2008 | Roof et al. | |
| 8,953,966 | B2 * | 2/2015 | Hase et al. ..... | G03G 15/2042 399/334 |
| 2004/0264991 | A1 | 12/2004 | Yoshikawa | |
| 2014/0050497 | A1 | 2/2014 | Jensen et al. | |
| 2014/0376938 | A1 | 12/2014 | Yamaoka et al. | |
| 2017/0010571 | A1 * | 1/2017 | Matsuda et al. ... | G03G 15/2053 |
| 2017/0168433 | A1 | 6/2017 | Okamoto et al. | |
| 2017/0248879 | A1 | 8/2017 | Ishigaya et al. | |
| 2018/0107142 | A1 * | 4/2018 | Samei et al. ..... | G03G 15/2053 |

FOREIGN PATENT DOCUMENTS

| | | | |
|---|---|---|---|
| CN | 104932234 | A | 9/2015 |
| CN | 105116704 | A | 12/2015 |
| CN | 106873335 | A | 6/2017 |
| JP | H05134575 | | 5/1993 |
| JP | 2001109322 | | 4/2001 |
| JP | 2008-268957 | A | 11/2008 |
| WO | WO-2016000748 | | 1/2016 |

* cited by examiner

HEAT SOURCE SEGMENTS ALIGNED WITH DIFFERENT SIZES

BACKGROUND

A heat source may provide heat to an element of a printing system during printing. A heat source may, for example, be provided as part of a printing system to heat printing material disposed on an element of the printing system.

DETAILED DESCRIPTION

Figure 1:
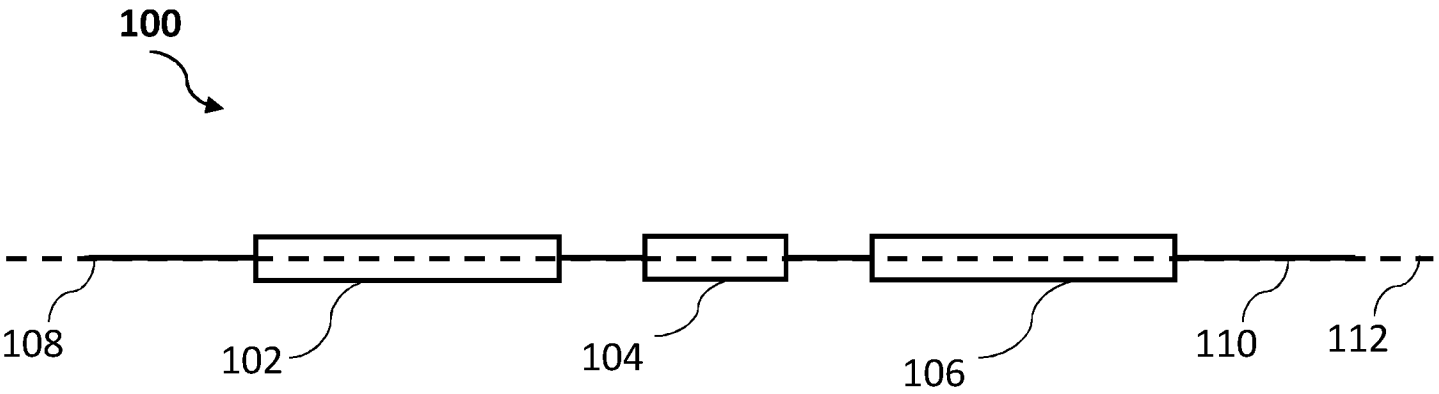
FIG. 1 is a schematic diagram of a first heat source.

In the following description, for purposes of explanation, numerous specific details of certain examples are set forth. Reference in the specification to "an example" or similar language means that a particular feature, structure, or characteristic described in connection with the example is included in that one example, but not necessarily in other examples.

In a printing system, a heating target may be an intermediate printing material transfer element (e.g. a printing blanket). Printing material may be transferred to the printing blanket before being transferred to a printing target (e.g. paper, card, etc.) to produce printing content. In some examples, the printing material may comprise a carrier oil which may, for example, comprise a suspension of particles that provide color to a printing target. When such printing material is transferred to the printing blanket, heat may be radiated to the printing blanket in order to melt the particles that provide color to provide ink or the like, and evaporate the carrier oil such that the ink or the like may then be transferred to the printing target.

In such cases, if heat is not uniformly received at the printing blanket, carrier oil may not fully evaporate from those parts of the printing blanket where less heat is received. This may cause unevaporated carrier oil to remain on the printing blanket, resulting in "memory content" to be produced in a subsequent printing process. Providing heat such that it is received uniformly along the length of the printing blanket according to the examples described below may inhibit or prevent memory content from being produced.

In addition, in prior art examples where heat is not uniformly received at the printing blanket, to mitigate the effects of memory content, the heat source of a printer may be operated to provide a large overall amount of heat per unit time so that those parts of the printing blanket that receive less heat may receive enough heat to evaporate the carrier oil at those locations. However, use of a heat source which results in heat uniformly being received at the printing blanket would allow the heat source to be operated to provide a lower overall amount of heat per unit time (because less heat being received at certain locations of the printing blanket would not be compensated for by providing a larger amount of heat overall).

Mitigating the effect of memory content may allow colors to be printing in various different orders. For example, in a printer in which the memory content effect is not mitigated, lighter colors (e.g. yellow) may be printed before darker colors (e.g. black). This is because black memory content would be more apparent than yellow memory content in the final printing content being produced. However, in examples in which the memory content effect is mitigated, for example by providing a heat source according to the examples described below, darker colors can be printed before lighter colors without significantly negatively impacting the quality of the printing content.

FIG. 1 illustrates an example of a heat source 100. The heat source 100 is for radiating heat onto an intermediate printing material transfer element of a printing apparatus.

The heat per unit time generated by the heat source 100 may vary along the heat source 100 such that a first part of the heat source 100 at or close to a first end 108 and a second part of the heat source 100 at or close to a second end 110 radiate a greater amount of heat per unit time than a third part of the heat source 100 disposed between the first part and the second part. In the example of FIG. 1, this variation in heat per unit time radiated from the heat source is achieved by providing a heat source 100 comprising a plurality of heat generating segment set apart from one another i.e. arranged such that there is a gap between heat generating segments. However, in another example, the heat source 100 may radiate heat along its entire length. The heat source 100 of FIG. 1 comprises the first end 108 and the second end 110, and a plurality of heat generating segments disposed along an axis 112 shown by a dashed line in FIG. 1.

The heat source 100 may also be referred to as a heating element 100 and the heat generating segments may also be referred to as heat producing portions, e.g. of a heating element.

The heat source 100 may, for example, be for radiating heat onto the intermediate printing material transfer element disposed at a given distance from the heat source 100 such that there is a substantially uniform distribution of heat per unit time (heat power) received along a length of the intermediate printing material transfer element.

The plurality of heat generating segments include a first heat generating segment 102, a second heat generating segment 104 and a third heat generating segment 106. In the example of FIG. 1, the second heat generating segment 104 is disposed between the first heat generating segment 102 and the third heat generating segment 106. In the example of FIG. 1, the first heat generating segment 102 is closer to the first end 108 of the heat source 100 than the second heat generating segment 104 and the third heat generating segment 106. The third heat generating segment 106 is closer to the second end 110 of the heat source 100 than the first heat generating segment 102 and the third heat generating segment 106. Although in the example of FIG. 1, heat source 100 is shown comprising three heat generating segments 102, 104, 106, any number of heat generating segments may be used in other examples. That is, heat source 100 may comprise a plurality of heat generating segments 104 ("intermediate segments") along the axis 112 between the first heat generating segment 102 and the third heat generating segment 106. In such cases, the lengths of the intermediate heat generating segments 104 may vary. For example, the respective length of an intermediate heat generating segment 104 may be shorter the nearer to the center of the heat source 100 that the intermediate segment 104 is located.

In the example of FIG. 1, the second heat generating segment 104 has a length shorter than a length of the first heat generating segment 102 and shorter than a length of the third heat generating segment 106. In other words, the first and second heat generating segments 102, 106 are disposed along a greater length of the heat source 100 than the second heat generating segment 104. In the example of FIG. 1 therefore, a greater amount of heat per unit time is radiated at parts of the heat source 100 at or close to its ends 108, 110 by virtue of longer heat generating segments 102, 106 being disposed at or close to the ends 108, 110 than in heat generating segments 104 disposed at locations between the parts of the heat source 100 at or close to the ends 108, 110. In the particular example of FIG. 1, the first heat generating segment 102 and the third heat generating segment 106 are substantially the same length.

The heat source 100 may comprise a filament, for example, a filament for a halogen bulb, such as a tungsten filament. In such examples, the plurality of heat generating segments 102, 104, 106 may be coiled segments of the filament, which may be spaced apart by segments of the filament that are not coiled. In other examples, the heat source 100 may comprise a coiled filament having a varying density of coiled loops along its length. For example, the heat source 100 may be more densely coiled at parts at or close to the first end 108 and second end 110 such that a greater amount of heat per unit time is generated at the parts of the heat source 100 at or close to the first end 108 and second end 110 than between these parts.

The heat generating segments 102, 104, 106 may generate heat when electrical power is supplied to the filament. It will be appreciated that although other parts of the heat source 100 may generate some heat, heat generating segments 102, 104, 106 as referred to herein are those segments of the heat source, for example coiled segments of a filament, which generate significant amounts of heat.

In other examples, the heat source 100 may comprise a resistive element the resistance of which varies along the length of the heat source 100. For example, heat source 100 may comprise a continuous resistive element with the parts of the resistive element at or close to the first and second ends 108, 110 having a higher resistance than the parts of the resistive element in between the parts at or close to the first and second ends 108 and 110, such that the parts of the resistive element at or close to the first and second ends 108 and 110 radiate a greater amount of heat per unit time than the parts in between the parts of the resistive element at or close to the first and second ends 108 and 110. In other examples, the heat source 100 may comprise spaced apart resistive elements of high resistance such that spaced apart elements define heat generating segments 102, 104, 106. It will be understood that the higher the electrical resistance of an element/segment, the more heat it will generate when electrical power is supplied to it. Examples of the heat source 100 may include any heat source which can be provided segmented to comprise heat generating segments 102, 104, 106.

Figure 2:
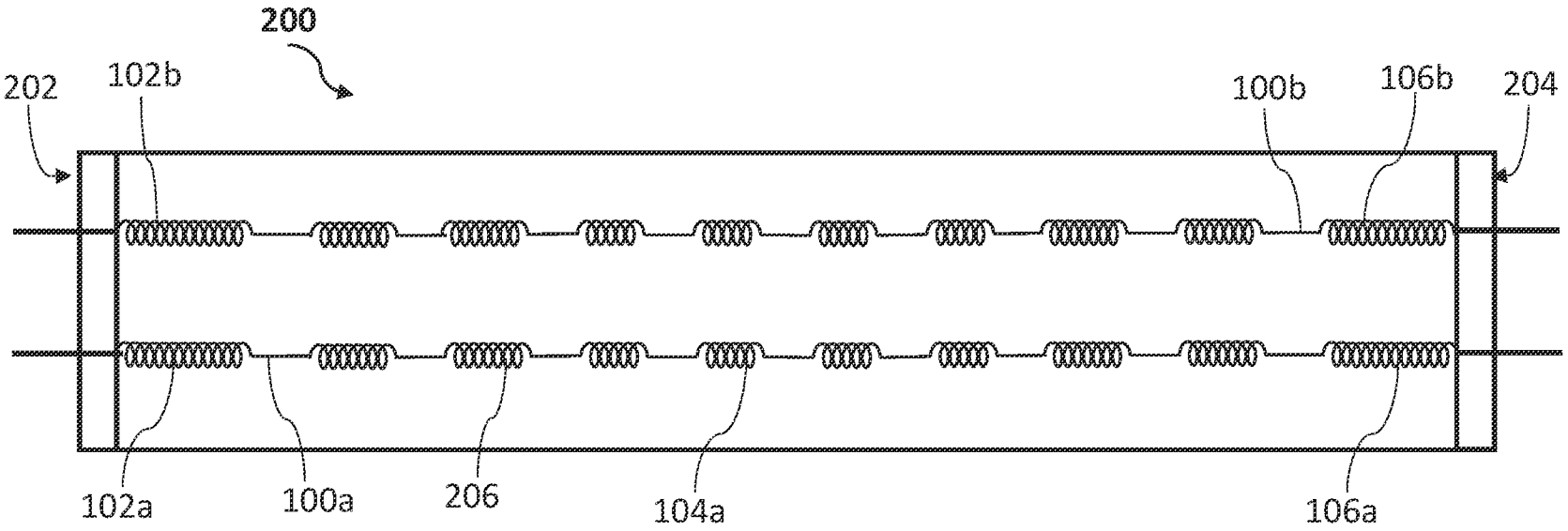
FIG. 2 is a schematic diagram of a second heat source.

In some examples, the heat source 100 may be part of a heater. FIG. 2 illustrates an example of a heater 200. In the example of FIG. 2, the heater 200 comprises two heat sources 100*a* and 100*b* disposed between a first end 202 and a second end 204 of the heater 200. The heat sources 100*a* and 100*b* may each be a heat source as described above in relation to FIG. 1. In this example, the heat sources 100*a* and 100*b* each comprise a single filament comprising a plurality of coiled segments. In this example, heat sources 100*a*, 100*b* each comprise multiple intermediate coiled segments between first respective end segments 102*a* and 102*b*, and second respective end segments 106*a* and 106*b*. The intermediate coiled segments may be of varying lengths. For example, intermediate segments 206 and 104*a* of heat source 100*a* have differing length. In this example, heat source 100*b* has the same arrangement of segment lengths as heat source 100*a*. However, in some examples the respective arrangements may differ.

Figure 3:
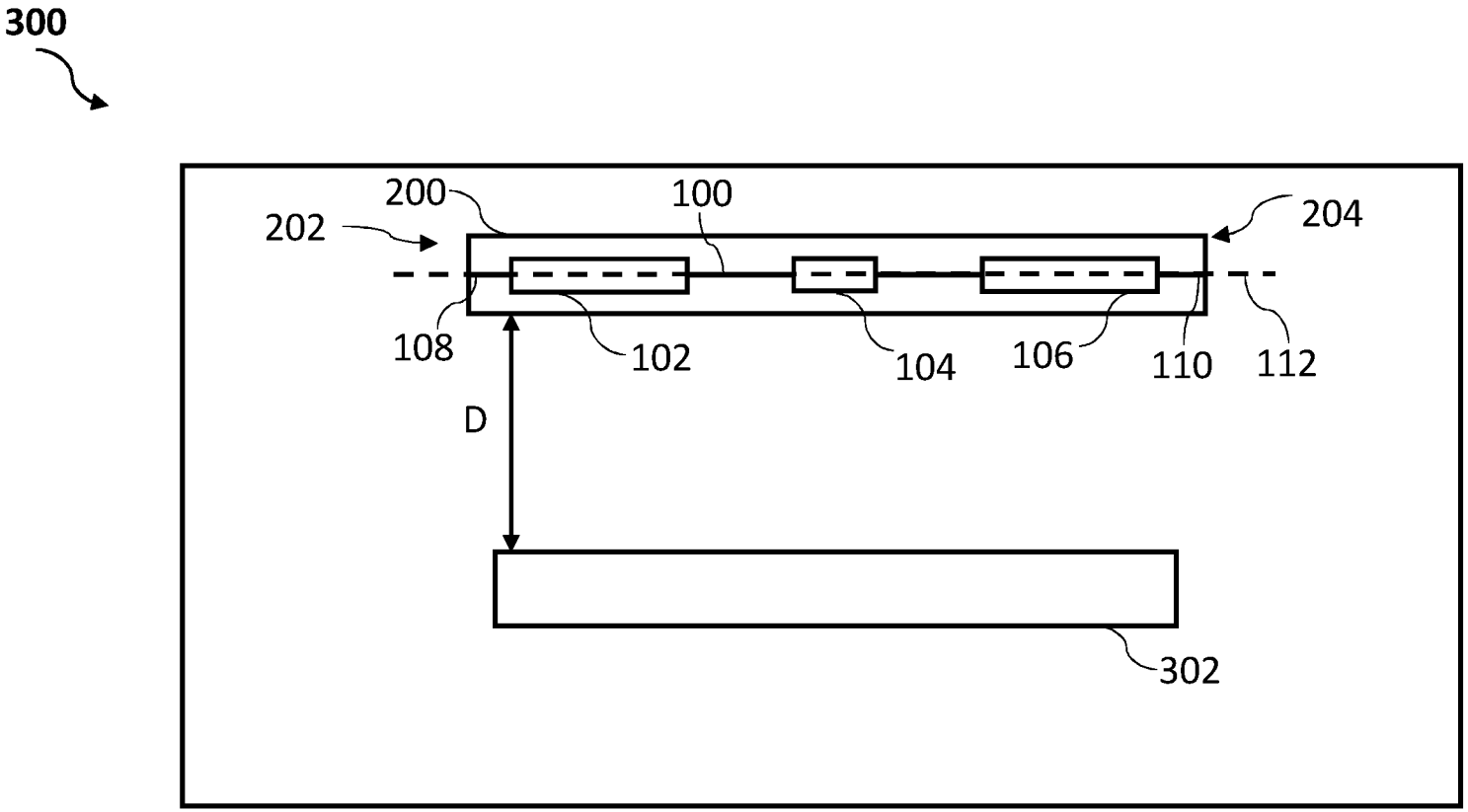
FIG. 3 is a schematic diagram of a printing system.

FIG. 3 illustrates a printing system 300 according to an example. The printing system 300 (hereinafter printer 300) may, comprise an intermediate printing material transfer element location 302 where an intermediate printing material transfer element such as a printing blanket may be placed. The location 302 may be referred to as the printing blanket location 302. The printer 300 also comprises a heater 200 comprising a heat source 100 for radiating heat onto a printing blanket placed at the printing blanket location 302 according to an example. As described above the heating element 100 is disposed between the first end 202 and the second end 204 of the heater 200, wherein the amount of heat generated per unit time by the heating element 100 varies along the heat source 100 between the first end 202 of the heater 200 and the second end 204 of the heater, such that the heat per unit time received at the printing blanket location 302 of the printing system 300 is substantially uniform along a length of the printing blanket location 302.

As described above, a printing blanket may be placed at the printing blanket location 302 in the printer 300. A printing blanket thus placed is an example of a heating target where heat radiated from the heater 200 is received. In the example of FIG. 3 the printing blanket location 302 is located at a distance D from the heater 200 and is arranged such that a printing blanket placed at printing blanket location 302 has a length parallel to the axis 112 along which the heat producing portions are disposed. This may facilitate heat radiated from the heater 200 being received substantially uniformly along a length of the printing blanket parallel to the axis 112, the printing blanket being placed at the printing blanket location 302. The printing blanket at location 302 may be disposed on a roller (not shown).

It will be appreciated that printer 300 may also comprise other elements not shown in FIG. 3. For example, the printer 300 may comprise a dispensing mechanism for dispensing printing material to print printing content onto a printing target. Printing material may, for example, be ink, toner, wax or the like.

The printer 300 may comprise a controller and a data storage unit (not shown) which together control the functioning of the printer 300. The printer 300 may also comprise a user interface (not shown) in order for the user to provide instructions to the printer 300.

Figure 4:
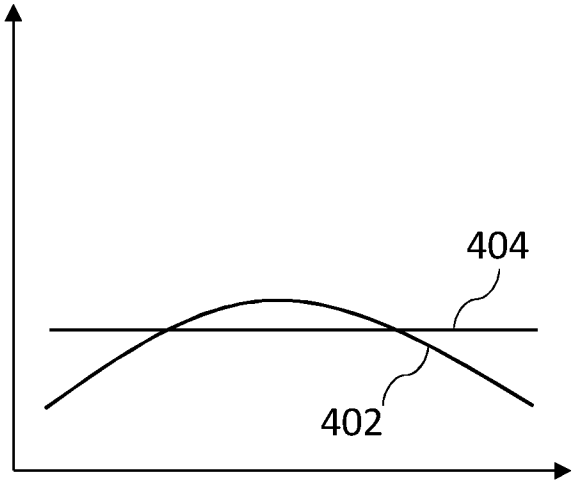
FIG. 4 is a graph showing examples of heat profiles.

FIG. 4 illustrates examples of heat profiles of heat power received at a heating target, such as a printing blanket, from a heat source. The vertical axis of the graph shown in FIG. 4 represents heat power received at the heating target, and the horizontal axis represents position along a length of the heating target. Curve 402 indicates that the heat power received at the heating target is not substantially constant as a function of position along the length of the heating target. Curve 402 indicates that a greater amount of heat power is received at the center of the heating target than at the ends of the heating target, for example. Curve 402 is an example of heat power received from a prior art heat source, which radiates heat uniformly along its length, at the heating target position at a given distance. It will be appreciated that heat power radiated from a prior art heat source, which radiates heat uniformly along its length, may not be received uniformly along the length of the heating target.

On the other hand, curve 404 is a heat profile of heat power received from heat source 100 at the heating target positioned at a given distance. Curve 404 is an example of a heat profile of heat received at the printing blanket location 302 referred to in relation to FIG. 3 above, when using a heat source according to an example. Curve 404 indicates a substantially uniform distribution of heat power (in other words, substantially constant heat power) received along the length of the heating target. This is because in this example the heat source 100 radiates a greater amount of heat power at or close to its ends, which results in a more even distribution of heat power compared to the prior art heat source.

A method of selecting a heat radiating pattern for a heat source will now be described. The method is for selecting a heat radiating pattern such that a heat profile at a heating target of heat radiated from the heat source having the selected heat radiating pattern from a specified distance is substantially the same as a desired heat profile of heat received at the heating target.

Figure 5:
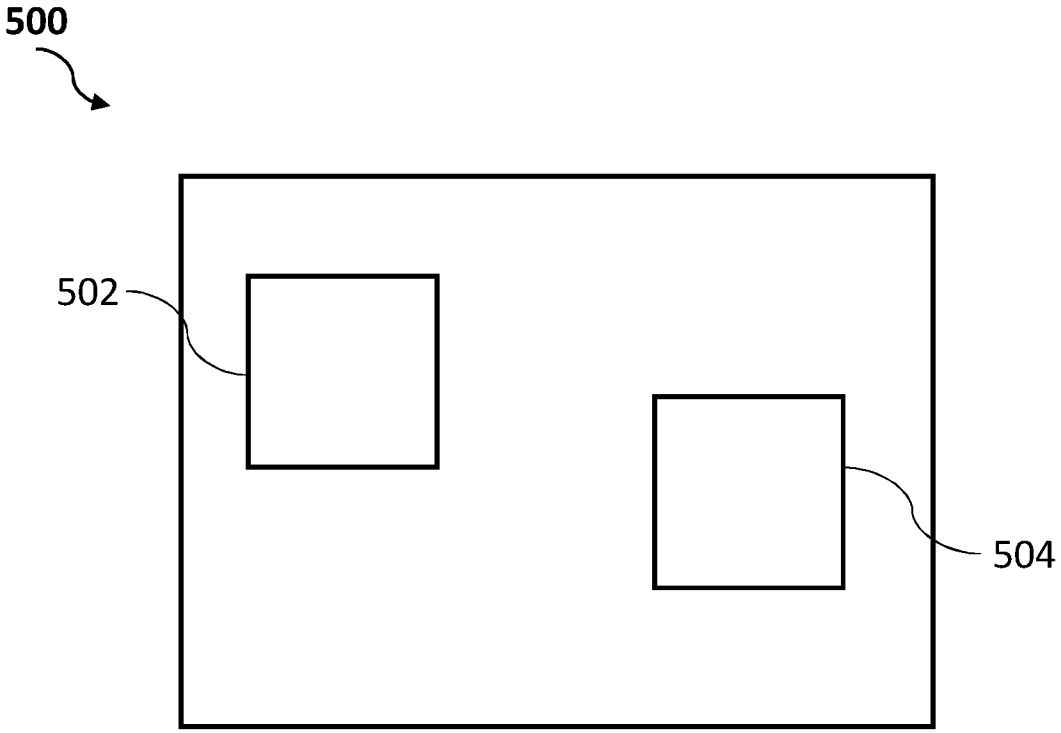
FIG. 5 is a schematic diagram of a computing system.

The method may, for example, be executed by a controller of a computing system. An example of a computing system 500 is shown in FIG. 5. The computing system 500 comprises a controller 502 and a data storage unit 504. The controller 502 may comprise circuitry and may be a general purpose processor, such as a central processing unit (CPU) or may comprise dedicated circuitry, for example. The controller 502 may be in data communication with the data storage unit 504. The controller 502 may be a processing unit arranged to execute instructions, for example computer programs, stored in the storage unit 504. The data storage unit 504 may, for example, be a non-transitory computer readable storage medium such as a Read Only Memory (ROM) or Random Access Memory (RAM), a hard disk drive, solid state drive, or flash memory.

Figure 6:
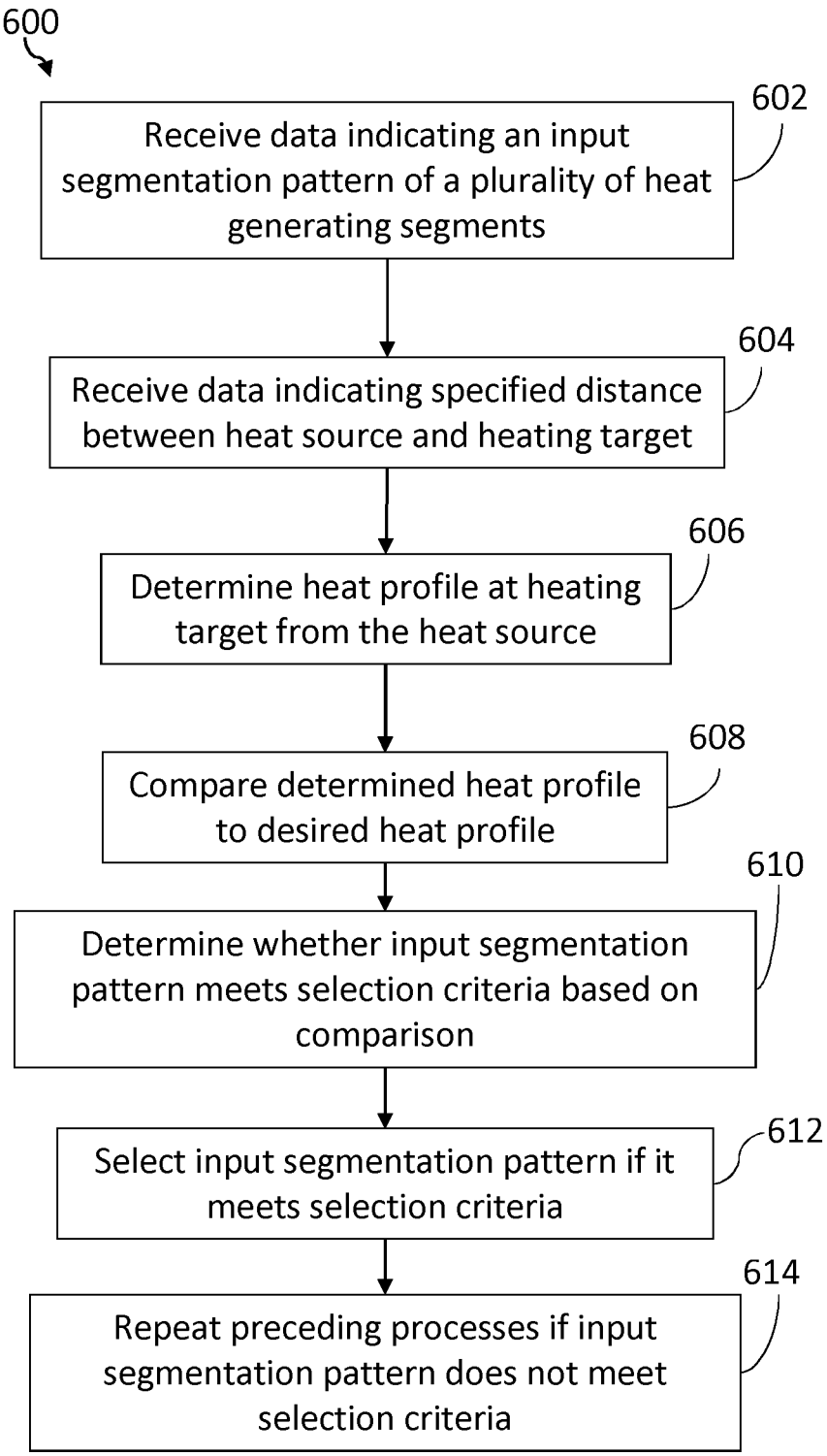
FIG. 6 is a flow diagram illustrating a method of selecting a heat radiating pattern.

Method 600 is illustrated in the flow diagram of FIG. 6. At 602 of method 600, data indicating an input heat radiating pattern of a heat source for radiating heat onto an intermediate printing material transfer element is received.

At 604, data indicating a specified distance between the heat source and the heating target is received.

For example, a user may input data indicating the specified distance and an input heat radiating pattern, which data is received by the controller 502. The user may thus specify the distance between the heat source and the heating target and the input heat radiating pattern. The input heat radiating pattern may, for example, specify a dimension and a relative position of each of the heat generating segments of a heat source according to an example described above. The data may be input using a data input device connected to the computing system 500 such as, for example, a mouse, a keyboard, or another input device for use with the computing system 500.

In other examples, the controller 502 may specify an input heat radiating pattern without a user input. For example, the controller 502 may specify an input heat radiating pattern by selecting a heat radiating pattern from a list of heat radiating patterns. The list of heat radiating patterns may comprise heat radiating patterns known to provide certain heat profiles at a heating target at respective specified distances, for example. The controller 502 may specify an input heat radiating pattern from this list which provides a heat profile close to the desired heat profile at the heating target at a distance equal to or close to the specified distance, for example. In some examples, the controller 502 may specify the input heat radiating pattern by performing a preliminary calculation. For example, the preliminary calculation may comprise estimating an input heat radiating pattern estimated to provide a heat profile close to the desired heat profile at the heating target at the specified distance.

At 606, a heat profile at the heating target of heat radiated from the heat source having the input heat radiating pattern from the specified distance is determined. For example, the heat profile of the input heat radiating pattern may be determined by calculating the heat power received at a plurality of points along a length of the heating target. The received heat power may, for example, be determined as heat per unit time received at a plurality of points along a length of the heating target.

Figure 7:
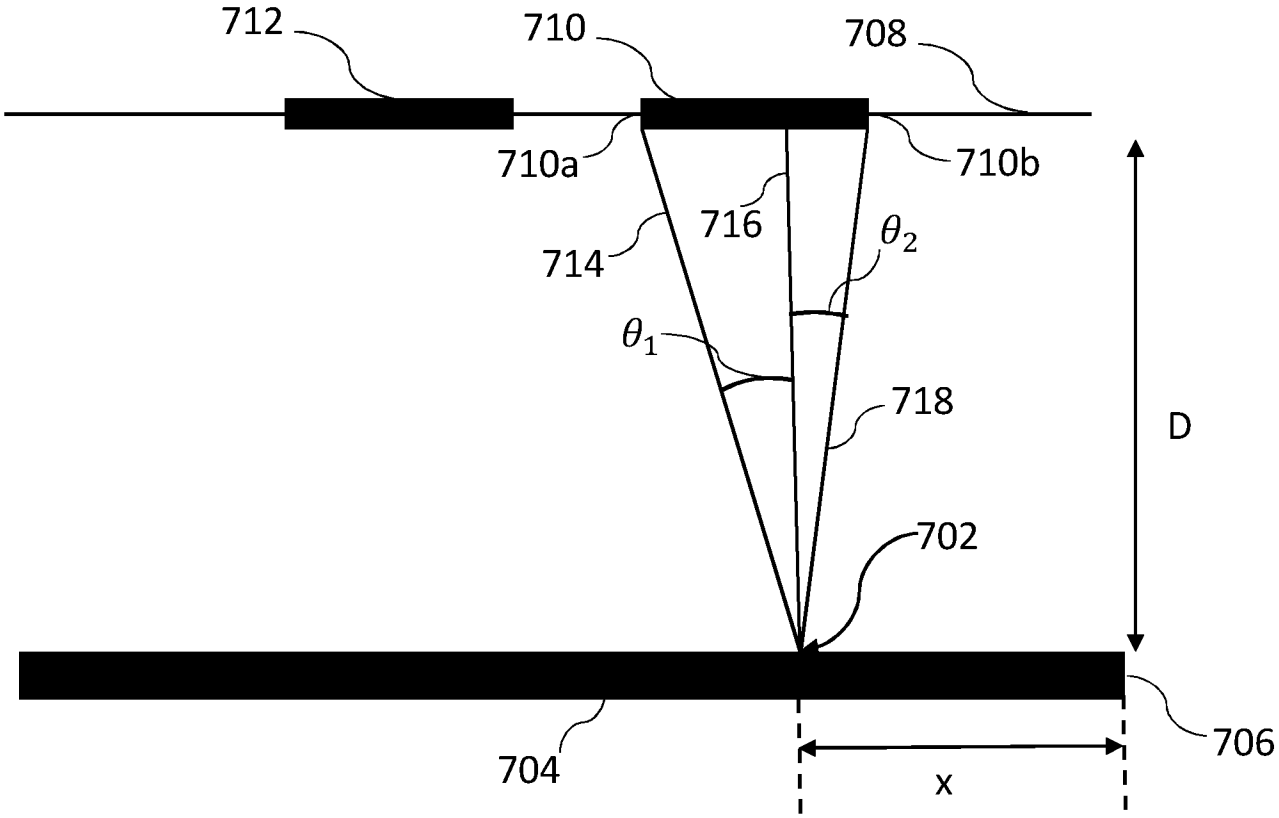
FIG. 7 is a schematic diagram of a heating arrangement.

An example of the calculation of the heat power received at a plurality of points along a length of the heating target is described with reference to the heating arrangement of FIG. 7. In the example of FIG. 7, a given point 702 is at a distance x along the heating target 704 from an end 706 of the heating target 704. In this example, the input heat radiating pattern specifies that heat source 708 comprises heat generating segments 710 and 712 as shown in FIG. 7. For example, the heat power received at the given point 702 from segment 710 may be calculated according to equation (1) below.

$$P_x = \frac{I_0}{D}\left(\frac{\theta_2 - \theta_1}{2} + \frac{\sin 2\theta_2 - \sin\theta_1}{4}\right) \tag{1}$$

In this example, $P_x$ is the total heat power received at point 702 from segment 710, $I_0$ is the heat power per unit length of the segment 710 (e.g. in units of Watts per millimetre), D is the distance between the heating target 704 and the heat source 708, and $\theta_1$ and $\theta_2$ are angles with respect to the segment 710 and the given point 702. Angle $\theta_1$ has its vertex at point 702 and is the angle between a line 714 connecting the point 702 to a first end 710*a* of the segment 710, and a line 716 originating at point 702 and perpendicular to the heating target 704. Angle $\theta_2$ has its vertex at point 702 and is the angle between a line 718 connecting the point 702 to a second end 710*b* of the segment 710, and the line 716. The heat power received from segment 712 at point 702 may be calculated in a similar manner. Heat power received at point 702 from all segments specified in the input heat radiating pattern may be calculated in a similar manner and summed to give the total heat power received at point 702 from the heat source 708. Heat power received at a plurality of points along the length of the heating target 704 may be calculated using equation (1) in this way, for example. Thus, in this example, the heat profile of heat power received at the heating target 704 due to the input heat radiating pattern may be calculated using equation (1).

The heat profile of the input heat radiating pattern represents power received at the heating target as a function of a length along the heating target. The determined heat profile of the input heat radiating pattern is compared to the desired heat profile at 608 of method 600.

The desired heat profile may, for example, be specified by the user. For example, data indicating the desired heat profile may be input by the user into computing system 500 using input devices of the computing system 500.

In some examples, the desired heat profile may be a flat heat profile. A flat heat profile, for example, indicates that heat is received at the heating target uniformly along a length of the heating target such that heat power as a function of position along a length of the heating target is substantially constant.

On the basis of the comparison at 608, it is determined whether or not the input heat radiating pattern meets a selection criteria at 610. The selection criteria, for example, may specify a level of similarity between the input heat radiating heat profile and the desired heat profile. If the level of similarity is achieved by the input heat radiating heat profile when compared to the desired heat profile, the selection criteria may be determined to be met.

For example, when the desired heat profile is a flat heat profile (e.g. as indicated by curve 404 of FIG. 4), the selection criteria may be such that an input heat radiating heat profile which is substantially flat meets the selection criteria. For example, the selection criteria for a flat desired heat profile may specify that a difference between the maximum power value and the minimum power value of an input heat radiating heat profile is below a threshold value. It will be appreciated that there are numerous examples of selection criteria that may be used. For example, a plurality of parameter values may be derived from the desired heat profile, as well as the input heat radiating heat profile, and respective pluralities of parameter values may be compared to determine a level of similarity between the desired heat profile and the input heat radiating profile.

At 612 of method 600, the input heat radiating pattern is selected if the input heat radiating pattern meets the selection criteria. However, if the input heat radiating pattern does not meet the selection criteria, 602 to 612 of method 600 are repeated at 614. Thus, method 600 may be iterated until an input heat radiating pattern is found which meets the selection criteria and therefore substantially provides that the desired heat profile is received at the heating target at the specified distance.

Although the flow diagram of FIG. 6 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. All such variations are within the scope of the present disclosure.

In examples, a heat source having a plurality of heat generating segments according to the selected heat radiating pattern may be made. For example, a heat source according to the selected heat radiating pattern may be made by coiling a filament such that said filament has the selected heat radiating pattern.

The heat source made according to the method and having the selected heat radiating pattern may be incorporated into a printing system 300 such as that described above, such that the heat source is disposed at the specified distance from the heating target.

Instructions which cause examples of the method 600 to be implemented may be specified using a computer programming language. Examples of programming languages include MATLAB, C++, C, FORTRAN, as well as numerous others.

It is to be understood that any feature described in relation to any one example may be used alone, or in combination with other features described, and may also be used in combination with any feature of any other of the examples, or any combination of any other of the examples. Furthermore, equivalents and modifications not described above may also be employed without departing from the scope of the accompanying claims.

What is claimed is:

1. A heat source comprising:

a plurality of heat generating segments disposed along an axis to radiate heat onto an intermediate printing material transfer element disposed at a given distance from the heat source, the plurality of heat generating segments including a first heat generating segment, a second heat generating segment, and a third heat generating segment, wherein the second heat generating segment is disposed between the first heat generating segment and the third heat generating segment, the second heat generating segment having a length shorter than a length of the first heat generating segment and shorter than a length of the third heat generating segment.

2. A heat source according to claim 1 comprising a filament, wherein the plurality of heat generating segments are coiled segments of the filament.

3. A heat source according to claim 2, comprising a filament for a halogen bulb.

4. A heat source according to claim 1, comprising a plurality of heat generating segments along the axis between the first heat generating segment and the third heat generating segment.

5. A heat source according to claim 1 to radiate heat onto the intermediate printing material transfer element disposed at a given distance from the heat source, wherein there is a substantially uniform distribution of heat per unit time received along a length of the intermediate printing material transfer element.

6. A printing system comprising:

a printing blanket location; and a heater for radiating heat onto a printing blanket placed at the printing blanket location, wherein the heater comprises:

a heating element disposed between a first end of the heater and a second end of the heater, wherein an amount of heat generated per unit time varies along the heating element between the first end of the heater and the second end of the heater, such that the heat per unit time received at the printing blanket location is substantially uniform along a length of the printing blanket location.

7. A printing system according to claim 6, wherein the heater comprises a plurality of heating elements.

8. A printing system according to claim 6, wherein the heating element comprises a plurality of heat producing portions.

9. A printing system according to claim 6, wherein a first part of the heating element at or close to a first end and a second part of the heating element at or close to a second end radiate a greater amount of heat per unit time than a third part of the heating element disposed between the first part and the second part.

10. A printing system according to claim 6, wherein:

the printing blanket is disposed on a roller; and heat radiated from the heater is received substantially uniformly on a part of a surface of the printing blanket facing the heating element.

11. A non-transitory computer-readable storage medium storing instruction that when executed by a processor, causes the processor to perform a method, the method comprising:

(i) receiving data indicating an input heat radiating pattern of a heat source for radiating heat onto an intermediate printing material transfer element;

(ii) receiving data indicating a specified distance between the heat source and a heating target;

(iii) determining a heat profile at the heating target of heat radiated from the heat source having the input heat radiating pattern from the specified distance;

(iv) comparing the determined heat profile to a desired heat profile;

(v) determining whether or not the input heat radiating pattern meets a selection criteria on the basis of the comparison of (iv);

(vi) selecting the input heat radiating pattern if the input heat radiating pattern meets the selection criteria; and (vii) repeating (i) to (v) if the input heat radiating pattern does not meet the selection criteria.

12. A method according to claim 11, wherein the input heat radiating pattern specifies a dimension and a relative position of each of a plurality of heat generating segments.

13. A method according to claim 11 further comprising making a heat source to radiate heat according to the input heat radiating pattern.

14. A method according to claim 13 further comprising incorporating the heat source into a printing system such that the heat source is disposed at the specified distance from the heating target.

* * * * *